US009989898B2

(12) United States Patent
Ohta et al.

(10) Patent No.: US 9,989,898 B2
(45) Date of Patent: Jun. 5, 2018

(54) RUBBING UNIT, FIXING DEVICE, IMAGE FORMING APPARATUS, AND MAINTENANCE METHOD OF FIXING DEVICE

(71) Applicant: Sharp Kabushiki Kaisha, Osaka (JP)

(72) Inventors: Motoki Ohta, Osaka (JP); Kota Yoshikawa, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days. days.

(21) Appl. No.: 15/414,029

(22) Filed: Jan. 24, 2017

(65) Prior Publication Data

US 2017/0212456 A1 Jul. 27, 2017

(30) Foreign Application Priority Data

Jan. 26, 2016 (JP) ..... 2016-012740

(51) Int. Cl.
*G03G 15/20* (2006.01)
*B24B 29/04* (2006.01)

(52) U.S. Cl.
CPC ..... *G03G 15/2025* (2013.01); *B24B 29/04* (2013.01); *G03G 2215/0132* (2013.01); *G03G 2215/2032* (2013.01)

(58) Field of Classification Search
USPC ..... 399/122, 320–323, 327
See application file for complete search history.

(56) References Cited

U.S. PATENT DOCUMENTS 8,509,666 B2 * 8/2013 Kobayashi ..... G03G 15/2053 399/122

FOREIGN PATENT DOCUMENTS

JP 2014-164074 A 9/2014

* cited by examiner

*Primary Examiner* — Hoan Tran
(74) *Attorney, Agent, or Firm* — Renner, Otto, Boisselle & Sklar, LLP

(57) ABSTRACT

A polishing unit is attached to an opening/closing cover included in a fixing device so as to polish a fixing belt. The polishing unit includes: a polishing unit body support member that is detachably attached to the opening/closing cover; and a polishing section that is held by the polishing unit body support member and that makes contact with the fixing belt so as to polish the fixing belt when the opening/closing cover is closed.

13 Claims, 9 Drawing Sheets

RUBBING UNIT, FIXING DEVICE, IMAGE FORMING APPARATUS, AND MAINTENANCE METHOD OF FIXING DEVICE

CROSS-REFERENCE TO THE RELATED APPLICATIONS

This application claims priority under 35 U.S.C. § 119 (a) on Patent Application No. 2016-012740 filed in Japan on Jan. 26, 2016, the entire contents of which are herein incorporated by reference.

BACKGROUND OF THE INVENTION

The present invention relates to a rubbing unit configured to rub a surface of a fixing belt and the like, a fixing device and an image forming apparatus that include the rubbing unit, and a maintenance method for the fixing device.

DESCRIPTION OF THE RELATED ART

When sheets are passed through a fixing device included in an image forming apparatus, a fixing belt may be scratched by an edge of a sheet, which results in a faulty image on a later sheet due to the scratch on the belt. For example, when the fixing belt has been scratched by an edge of an A4 sheet, there occurs a faulty image such as vertical streaks (in the sheet transport direction) when an image is fixed, later, on a sheet larger than the A4 sheet such as a B4 sheet or an A3 sheet.

Conventionally, when the fixing belt has been scratched as described above, a service person detaches the fixing device from an apparatus main body to replace the fixing device or the fixing belt with a new one. However, it is necessary to call a service person to replace the units or components, which means that the image forming apparatus is being stopped and cannot be used until the service person comes.

There is another problem that the replacement of the fixing device requires high replacement costs. In contrast, when replacing the fixing belt, the replacement costs can be reduced, however, it is necessary to disassemble the fixing device, which leads to waste in time for replacement.

Apart from the replacement of the units or components, it is possible to use a method for polishing and restoring the scratched belt by a tool and the like. However, polishing the scratched belt by the tool requires proper setting of the contact pressure against the belt during the polishing operation, which is accessible only to the service person. In any case, the user himself/herself cannot settle the problem.

As a technology that does not require any operation by the service person, Patent Document 1 discloses the technology for restoring a scratch on a fixing belt with a polishing roller of a polishing unit that is provided in a fixing device. In Patent Document 1, a rubbing unit can appropriately adjust the contact pressure of the polishing roller against the fixing belt during the polishing operation.

[Patent Document 1]: JP 2014-164074 A

SUMMARY OF THE INVENTION

Using the technology disclosed in Patent Document 1, it is possible to automatically polish the scratch on the fixing belt, which does not require any operation by the service person. However, such a technology requires a configuration of the fixing device that is provided with a polishing unit including a polishing roller, a motor and the like, although this polishing unit is not required for the normal fixing operation. This will cause upsizing of the fixing device, which results in upsizing of the image forming apparatus.

The present invention was made in consideration of the above circumstances, an object of which is to provide a rubbing unit and a maintenance method using the rubbing unit to perform maintenance on the fixing belt (e.g. restoration of the scratched belt) without requiring any operation by a service person and to prevent the fixing device from being upsized.

In order to solve the above problem, a rubbing unit of the present invention is to be used in a device having a rotary member and a pivoting member that covers the rotary member. The rubbing unit, which is configured to rub the rotary member, includes: a support member that is detachably attached to the pivoting member; and a rubbing member that is held by the support member and that makes contact with the rotary member so as to polish a surface of the rotary member when the pivoting member is closed.

With the above-described configuration, when the maintenance operation is performed by the rubbing unit to restore the surface nature of the rotary member included in the fixing device, the rubbing unit is attached to the pivoting member of the fixing device, and the rubbing member makes contact with the rotary member to rub the rotary member when the pivoting member is closed. Thus, it is possible to restore the surface nature of the rotary member. In this way, the rubbing unit can be easily attached to the fixing device by the user, which means that the maintenance can be performed on the fixing device without calling the service person. Also, the polishing unit is attached to the fixing device only when the maintenance is performed. Thus, there is no need that the fixing device itself always be provided with the maintenance means, which results in downsizing of the fixing device.

In the above-described rubbing unit, the rubbing member may be detachably attached to the rubbing unit.

With the above-described configuration, when the maintenance effect by the rubbing member is lost, such a depleted rubbing member can be easily replaced with a new one.

In the above-described rubbing unit, the rubbing member may be attached to a simulated peeling member that is mounted on the support member.

With the above-described configuration, the rubbing member can be easily guided by the simulated peeling member to a position where the rubbing member appropriately makes contact with the rotary member.

In the above-described rubbing unit, the rubbing member may be a member configured by adding, to the simulated peeling member that is mounted on the support member, a function of polishing the surface of the rotary member.

With the above-described configuration, the simulated peeling member having a function as the rubbing member can be easily guided to a position where the simulated peeling member appropriately makes contact with the rotary member, and furthermore it is possible to reduce the number of components.

In the above-described rubbing unit, the simulated peeling member may have a shape similar to a peeling member configured to peel, from the rotary member, a sheet on which an image has been formed.

In the above-described rubbing unit, a plurality of claw-like members may be arranged, as the simulated peeling member, along the rotary member at a predetermined interval.

With the above-described configuration, the contact pressure can be easily applied to the portion of the rotary member to be subjected to the maintenance operation, thus the maintenance can be suitably performed on the rotary member.

In the above-described rubbing unit, the rubbing member may be an abrasive to polish the rotary member.

With the above-described configuration, when the rotary member such as the fixing belt is scratched by an edge of the sheet, it is possible to polish and restore the scratched portion by the rubbing unit.

In the above-described rubbing unit, a position of the rubbing member relative to the support member may be adjusted in a direction perpendicular to the sheet transport direction.

The scratch on the rotary member by the edge of the sheet is generated at a specific position corresponding to the size of the sheet. Thus, by positioning the rubbing member at the specific position, it is possible to polish only the portion to be polished, and to avoid the polishing of the portion that does not require the polishing (i.e., portion where no scratch is generated).

In the above-described rubbing unit, indexes indicating respective sizes of sheets may be disposed on the support member so that the position of the rubbing member is adjusted corresponding to the indexes.

With the above-described configuration, it is possible to easily adjust the position of the maintenance unit by positioning the rubbing member corresponding to the indexes.

DESCRIPTION OF PREFERRED EMBODIMENTS

First Embodiment

Figure 1:
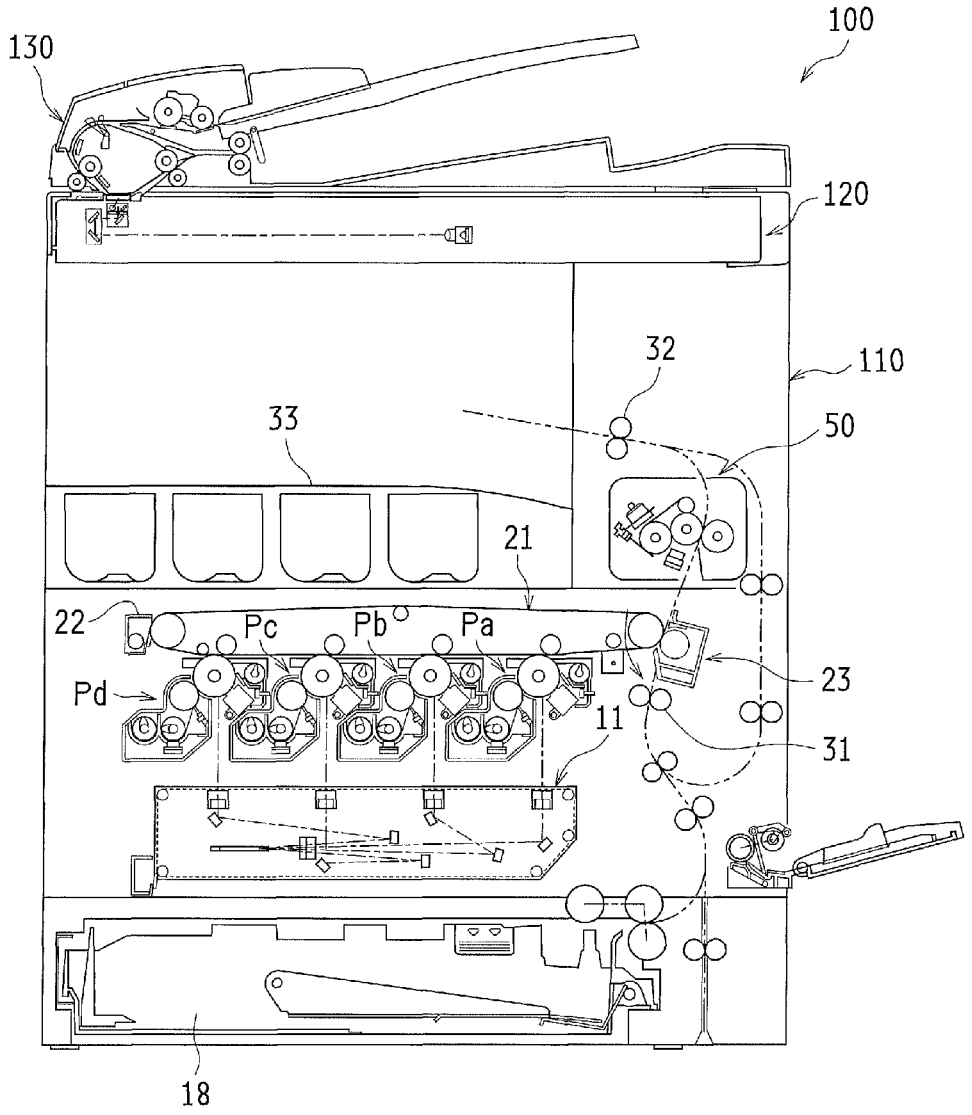
FIG. 1 is a cross-sectional view showing a schematic configuration of an image forming apparatus to which the present invention is applied.
Figure 2:
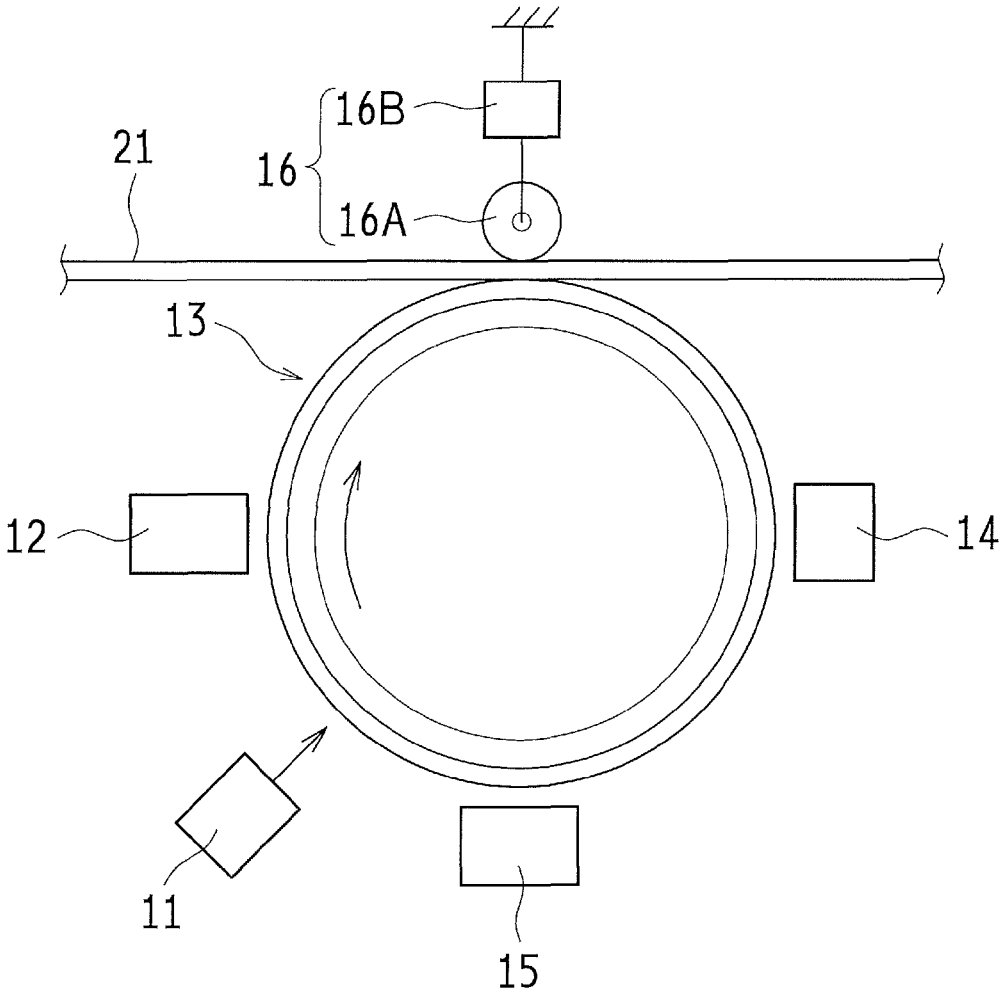
FIG. 2 is a diagram for explaining an image-forming process by the image forming apparatus.

Hereinafter, description will be given in detail on the first embodiment with reference to the drawings. FIG. 1 is a cross-sectional view showing a schematic configuration of an image forming apparatus 100 to which the present invention is applied. FIG. 2 is a diagram for explaining an image-forming process by the image forming apparatus 100.

As shown in FIG. 1, the image forming apparatus 100 includes: a main body 110; an original reading device 120; and an original transport device 130. Inside the main body 110 is installed an image forming device to print an image on a recording sheet. The original reading device 120 is disposed on the main body 110 so as to read an original when copying the original.

The original transport device 130 is disposed on the original reading device 120 and is pivoted upwardly about a rear side of the original transport device 130 so as to open a front side of the original transport device 130. The original transport device 130 transports, in the automatic reading mode, originals that are placed on an original setting tray sequentially onto an original platen of the original reading device 120.

The image forming apparatus 100 handles image data corresponding to a color image using black (K), cyan (C), magenta (M) and yellow (Y) or corresponding to a monochrome image using a single color (e.g., black). For this reason, the image forming apparatus 100 includes four image stations Pa, Pb, Pc and Pd respectively associated with black, cyan, magenta, and yellow so as to generate four kinds of toner images corresponding to the respective colors. Each of the image stations Pa, Pb, Pc and Pd includes a development device 12, a photosensitive drum 13, a drum cleaning device 14 and a charging unit 15 (see FIG. 2).

The image stations Pa, Pb, Pc and Pd share an optical scanning device 11. Specifically, the optical scanning device 11 includes a polygonal mirror and four semiconductor lasers (not shown). Respective laser beams emitted from the four semiconductor lasers are scanned, by the rotational polygonal mirror, at their optical paths different from one another in the main scanning direction. Then each laser beam enters a surface of a corresponding photosensitive drum 13 of the image stations Pa, Pb, Pc and Pd via optical members such as lenses and mirrors.

In each of the image stations Pa, Pb, Pc and Pd, the tonner image is formed on the photosensitive drum 13 in the following steps: after removing and collecting residual toner on the surface of the photosensitive drum 13 by the drum cleaning device 14, charging the surface of the photosensitive drum 13 at a predetermined potential uniformly by the charging unit 15; exposing the surface of the photosensitive drum 13 to light by the optical scanning device 11 so as to generate an electrostatic latent image on the surface; and developing the electrostatic latent image by the development device 12. Thus, each toner image of the corresponding color is formed on the surface of the corresponding photosensitive drum 13.

Sequentially, after residual toner on an intermediate transfer belt 21 is removed and collected by a belt cleaning device 22 while the intermediate transfer belt 21 is being moved circularly, the toner image of each color formed on the surface of the corresponding photosensitive drum 13 is sequentially transferred and superimposed to each other on the intermediate transfer belt 21 by a transfer unit 16 (transfer roller 16A and power source 16B). Thus, a color toner image is formed on the surface of the intermediate transfer belt 21.

A nip region is formed between the intermediate transfer belt 21 and a transfer roller of a secondary transfer device 23. The recording sheet, which has been transported via a sheet transport path, is transported with being sandwiched in the nip region, and at that time, the color toner image on the surface of the intermediate transfer belt 21 is transferred on the recording sheet. Then the recording sheet is heated and pressurized by a fixing device 50 so that the color toner image is fixed on the recording sheet.

Meanwhile, the recording sheet is drawn from a sheet feed cassette 18 and transported via the sheet transport path so as to pass through the secondary transfer device 23 and the fixing device 50. Finally, the recording sheet is discharged to a discharge tray 33 via discharge rollers 32. The sheet transport path is provided with, for example: registration rollers 31 that transport the recording sheet at a timing when the color toner image is transferred in the nip region; transport rollers transporting the recording sheet; and the discharge rollers 32.

Hereinafter, a belt fixing type fixing device is described as an example of the fixing device according to this embodiment.

Figure 3:
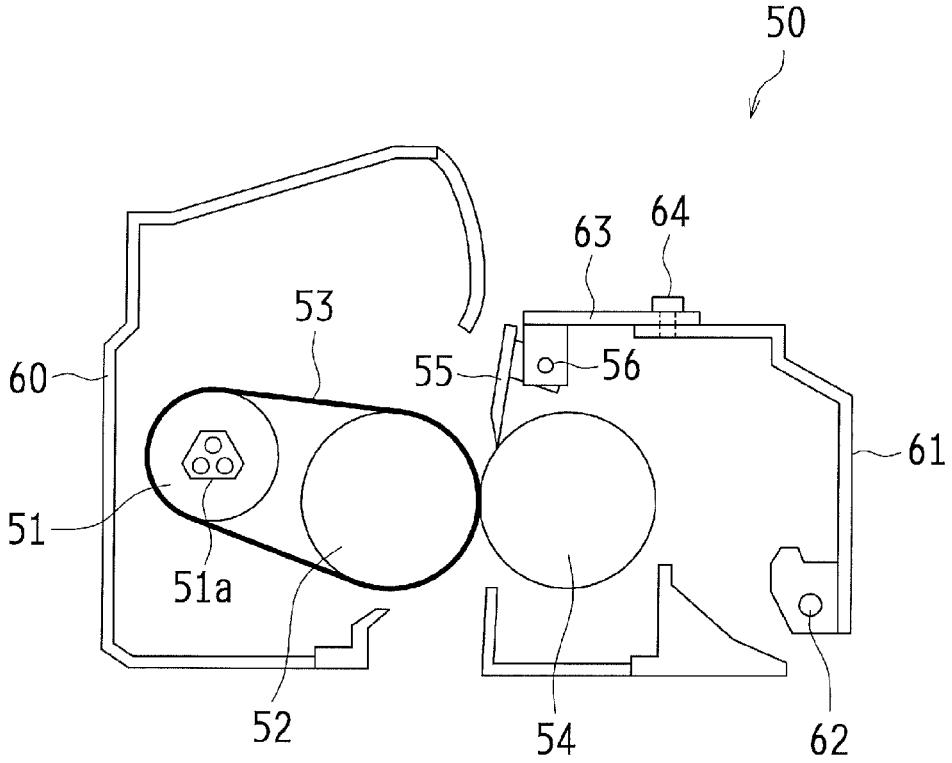
FIG. 3 is a cross-sectional view showing a schematic configuration of a fixing device according to the first embodiment.

FIG. 3 is a cross-sectional view showing a schematic configuration of the fixing device 50 according to this embodiment. The fixing device 50 includes a heating roller 51, a fixing roller 52, a fixing belt 53 and a pressure roller 54. The fixing belt 53 is an endless belt wound on the heating roller 51 and the fixing roller 52 so as to transmit heat from the heating roller 51 to the fixing roller 52. The fixing belt 53 has a predetermined thickness (e.g. 250 μm). The pressure roller 54 is pressed against the fixing roller 52 with the fixing belt 53 being interposed therebetween. The fixing nip region is formed between the fixing belt 53 and the pressure roller 54.

The heating roller 51 and the fixing roller 52 each include a cylindrical-shaped core metal. A heat source (here, a halogen heater lamp) 51*a* is provided inside the heating roller 51. Thereby, the heating roller 51 is heated by the heat source 51*a* so that the heat of the heating roller 51 is conducted to the fixing belt 53. The heat is further conducted to the surface of the fixing roller 52 via the fixing belt 53 so as to heat the fixing roller 52.

In the fixing device 50, the recording sheet on which an unfixed toner image is formed is received, and is transported with being sandwiched between the fixing belt 53 and the pressure roller 54. When the recording sheet is transported while being sandwiched between the fixing belt 53 and the pressure roller 54, the recording sheet is heated and pressurized in the fixing nip region. Thus, the unfixed toner image on the recording sheet is fused, mixed, and pressed so as to be thermally fixed.

The fixing device 50 has a plurality of peeling claws 55. The peeling claws 55 are members to peel the recording sheet from a rotary member (i.e., fixing belt 53 or pressure roller 54) of the fixing device 50, and thus prevent the recording sheet that is sandwiched and held in the fixing nip region between the fixing belt 53 and the pressure roller 54 from wrapping around the rotary member (here, pressure roller 54).

Now a housing structure of the fixing device 50 is described. The fixing device 50 has a lifetime, and its performance is gradually deteriorated. For this reason, when the accumulated operation time of the fixing device 50 or the number of sheets subjected to fixing reaches a predetermined value, it is considered that the fixing device 50 has come to the end of the life, accordingly, the fixing device 50 is replaced with a new one. In order to make the replacement operation easy, the fixing device 50 is formed as a unit, and the heating roller 51, the fixing roller 52, the fixing belt 53 and the pressure roller 54 are housed in its housing structure.

The housing structure of the fixing device 50 is constructed by a main housing 60 and an opening/closing cover (pivoting member) 61. The main housing 60 secures and supports each rotation shaft of the heating roller 51, the fixing roller 52 and the pressure roller 54. The opening/closing cover 61 is to cover the heating roller 51, the fixing roller 52, the fixing belt 53 and the pressure roller 54 inside the fixing device 50. The opening/closing cover 61 is attached to the main housing 60 so as to be pivotable about a hinge part 62, thus can be opened/closed by being pivoted about the hinge part 62. The pivot shaft of the hinge part 62 is parallel to the respective rotation shafts of the heating roller 51, the fixing roller 52 and the pressure roller 54. FIG. 3 shows the fixing device 50 in a state in which the opening/closing cover 61 is closed.

To the other end of the opening/closing cover 61, which is opposite to the hinge part 62, a peeling claw support member 63 is fixedly attachable. The peeling claw support member 63 is a plate-like member that holds the plurality of peeling claws 55, and is detachably attached to the opening/closing cover 61 using a plurality of screws 64. The peelings claws 55 are attached to one end (opposite to the end attached to the opening/closing cover 61) of the peeling claw support member 63 so as to be pivoted, about a hinge part 56, within a certain range. When the opening/closing cover 61 is closed, the peeling claws 55 are guided to the fixing nip region between the fixing belt 53 and the pressure roller 54 to perform the peeling function on the recording sheet as described above.

As described in the background art, in the fixing device 50, when the recording sheet is passed through the fixing nip region, the fixing belt 53 may be scratched by the edge of the sheet, which causes a faulty image such as vertical streaks in the image on the recording sheet. In order to eliminate the faulty image, it is necessary to perform maintenance on the fixing belt 53. Specifically, in case of the fixing device 50 according to this embodiment, the scratched fixing belt 53 is polished and restored. Note that the maintenance operation performed by the rubbing unit of the present invention means overall operation to rub the surface of the rotary member and restore its surface nature. Thus, polishing and restoring the surface of the scratched belt is merely one example of the maintenance operation, and the present invention is not limited thereto.

Figure 4:
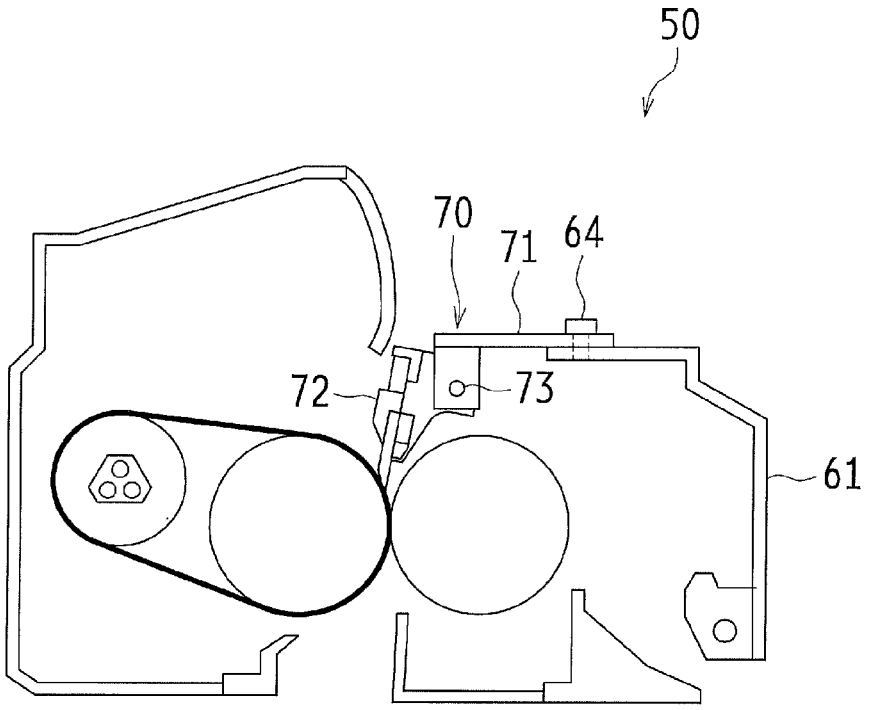
FIG. 4 is a cross-sectional view of the fixing device shown in FIG. 3 to which a polishing unit is attached.
Figure 5:
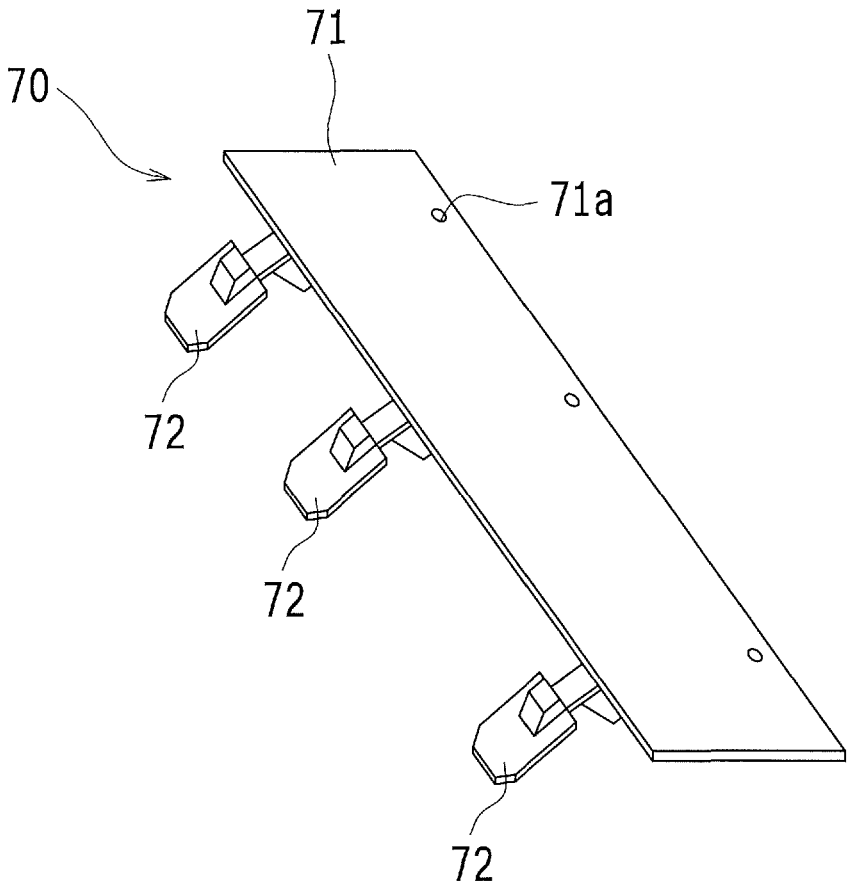
FIG. 5 is a perspective view of a polishing unit according to the first embodiment.

In the fixing device 50, a polishing unit (rubbing unit) 70 shown in FIGS. 4 and 5 is used for polishing the scratched fixing belt 53. Note that the target for the maintenance operation by the rubbing unit of the present invention is not limited to the fixing belt. The maintenance operation may be performed on the other rotary members such as the heating roller and the pressure roller.

The polishing unit 70 can be attached to the opening/closing cover 61 in place of the peeling claw support member 63 that is detached from the opening/closing cover 61. FIG. 4 is a cross-sectional view of the fixing device 50 to which the polishing unit 70 is attached in place of the peeling claw support member 63. FIG. 5 is a perspective view of the polishing unit 70 detached from the fixing device 50.

The polishing unit 70 includes a polishing unit body support member (support member) 71 and a plurality of polishing sections 72. The polishing unit body support member 71 is a plate-like member that holds the plurality of polishing sections 72. The polishing unit body support member 71 is detachably attached to the opening/closing cover 61 using the plurality of screws 64, similarly to the peeling claw support member 63. For this reason, a plurality of screw holes 71*a* is disposed in the polishing unit body support member 71 so as to be arranged along a side of the polishing unit body support member 71 to be attached to the opening/closing cover 61. The polishing sections 72 are attached to one end (opposite to the end attached to the opening/closing cover 61) of the polishing unit body support member 71 so as to be pivoted, about a hinge part 73, within a certain range.

Figure 6:
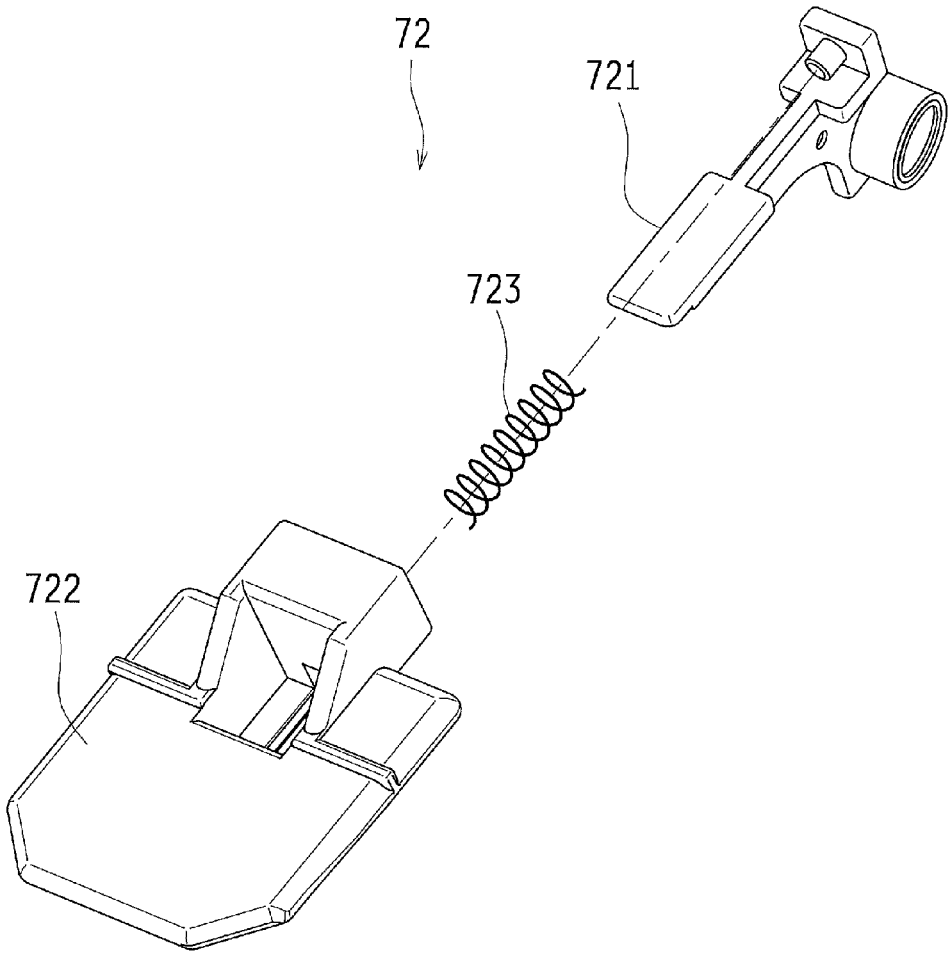
FIG. 6 is an exploded perspective view of a polishing section of the polishing unit shown in FIG. 5.

FIG. 6 is an exploded perspective view of the polishing section 72. As shown in FIG. 6, each polishing section 72 is constituted by a claw-like member (simulated peeling member) 721 having a shape similar to the peeling claw 55, a polishing member (rubbing member) 722 and a spring 723. That is, the polishing section 72 has a configuration in which the claw-like member 721 is attached to the polishing unit body support member 71 via the hinge part 73 and the polishing member 722 is detachably attached to a front edge of the claw-like member 721. The spring 723 is interposed between the claw-like member 721 and the polishing member 722 so as to bias the polishing member 722 toward the fixing belt 53 when the maintenance is performed on the fixing belt 53.

When the opening/closing cover 61 is closed, the polishing member 722 is guided to the fixing nip region between the fixing belt 53 and the pressure roller 54 to perform the maintenance function (i.e., polishing function) on the fixing belt 53. That is, an abrasive such as aluminum oxide is applied onto a rubbing surface of the polishing member 722, which is facing the fixing belt 53. Alternatively, a polishing sheet may be adhered, using a double-faced adhesive tape or the like, to the rubbing surface of the polishing member 722, which is facing the fixing belt 53. The spring 723 gives the polishing member 722 an appropriate contact pressure against the fixing belt 53.

The claw-like member 721 is a claw-shaped member whose narrow-width portion in the direction parallel to the rotation shaft of the fixing belt 53 makes contact with the fixing belt 53. Specifically, the shape of the claw-like member 721 that is viewed in the direction of the rotation shaft of the fixing belt 53 is gradually narrowed from the portion attached to the polishing unit body support member 71 to the front edge portion. In this respect, the claw-like member 721 is similar to the peeling claw 55. Using such a claw-like member 721, the contact pressure is easily applied to the scratch portion of the fixing belt 53, thus it is possible to suitably polish the scratched belt.

As described above, the scratched belt of the fixing device 50 is polished in a state in which the polishing unit 70 is attached to the opening/closing cover 61 in place of the peeling claw support member 63 that has been detached from the opening/closing cover 61. The replacement operation of the peeling claw support member 63 with the polishing unit 70 is performed in a state in which the fixing device 50 is removed from the image forming apparatus 100 and the opening/closing cover 61 is opened. As the replacement operation described above, only fastening the screws 64 is substantially included, and there is no need to adjust the position of the polishing unit 70 and the like. Therefore, the above-described replacement operation can be easily performed by the user, which means that the maintenance can be performed on the fixing belt 53 without calling the service person. Also, the polishing unit 70 is mounted on the fixing device 50 only when the maintenance is performed on the fixing belt 53. Thus, there is no need that the fixing device 50 itself always be provided with the maintenance means, which results in downsizing of the fixing device 50.

The polishing section 72 is disposed in the polishing unit 70 corresponding to the portion of the belt where the scratch is likely to be generated, that is, the position of the edge of the sheet. Since multiple size of sheets are passed through the fixing device 50, the multiple portions of the belt may be scratched (hereinafter referred to as "scratched portions"). Thus, the multiple polishing sections 72 respectively corresponding to the scratched portions are disposed in the polishing unit 70. However, when the maintenance is performed on the fixing belt 53, all of the scratched portions have not been necessarily scratched. For this reason, if the fixing belt 53 is polished by all of the polishing sections 72 disposed in the polishing unit 70, the polishing may be performed on a portion that does not require the polishing (i.e., portion where no scratch has been generated), which results in an excessive abrasion of the fixing belt 53. In order to avoid such an excessive abrasion, the polishing members 722 can be attached to only the claw-like members 721 of the polishing sections 72 corresponding to the scratched portions of the belt.

The image forming apparatus 100 according to this embodiment has a maintenance mode to perform the maintenance on the fixing device 50. The maintenance mode is an operation mode that is performed in a state in which the polishing unit 70 is mounted on the fixing device 50. In the maintenance mode, the fixing belt 53 of the fixing device 50 is rotated for a predetermined period of time while the heat source of the heating roller 51 is being turned off. The image forming apparatus 100 is provided with a control program to execute the maintenance mode, and the maintenance mode is started, for example, when the user selects the maintenance mode on an operation panel of the image forming apparatus 100 and then presses a start button.

In the above-described polishing unit 70, each polishing section 72 is constituted by the claw-like member 721, the polishing member 722 and the spring 723. Using the spring 723, this configuration has an advantage that the design is easy to obtain a suitable contact pressure of the polishing member 722 against the fixing belt 53. However, the present invention is not limited thereto. The polishing member 722 may be detachably attached to the peeling claw 55 originally included in the fixing device 50 so that the fixing belt 53 is polished by the polishing member 722 attached to the peeling claw 55. In this configuration, it is not necessary to replace the peeling claw support member 63 with the polishing unit 70, and the fixing belt 53 can be polished by only attaching the polishing member 722 to the peeling claw 55. Also, in this configuration, the peeling claw support member 63 corresponds to the support member recited in the claims, and the peeling claw 55 corresponds to the simulated peeling member recited in the claims. That is, by attaching the polishing member 722, the rubbing unit of the present invention is made up of the peeling claw support member 63, the peeling claw 55 and the polishing member 722. In this configuration, the peeling claw 55 serves as a part of the rubbing unit to hold the polishing member 722, and does not peel the sheet. Accordingly, the peeling claw 55 is here considered to be the simulated peeling member. Furthermore, the peeling claw 55 should be positioned, in advance, corresponding to a portion of the belt that may be scratched by a sheet with a certain size.

Also, in the above-described polishing unit 70, the claw-like member 721 and the polishing member 722 are separate members, and the polishing member 722 can be detachably attached to the claw-like member 721. However, the present invention is not limited thereto. The polishing section 72 may be a single member integrally formed by the claw-like member and the polishing member. One example of the configuration in which the claw-like member and the polishing member are formed as an single member will be a claw-like member whose front edge is served as a polishing member by applying the abrasive onto the front edge of the claw-like member. This configuration has an advantage that the number of members for forming the polishing unit 70 can be reduced.

Second Embodiment

Figure 7:
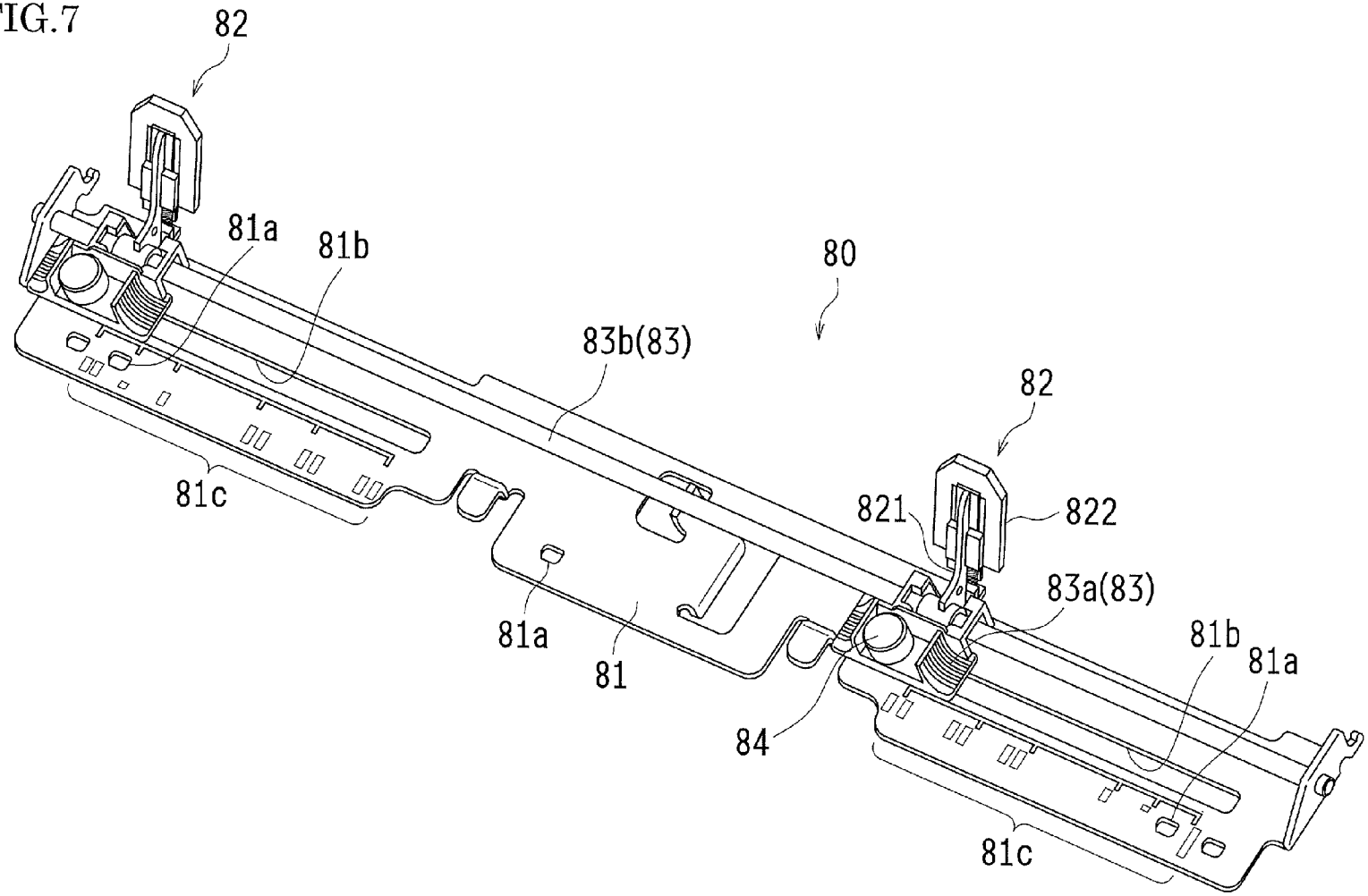
FIG. 7 is a perspective view of a polishing unit according to the second embodiment.

Hereinafter, description will be given on the polishing unit according to the second embodiment with reference to the drawings. FIG. 7 is a perspective view of a polishing unit (rubbing unit) 80 according to the second embodiment. The polishing unit 80 includes a polishing unit body support member (support member) 81 and at least one (in FIG. 7, two) polishing section 82. The polishing unit 80 differs from the polishing unit 70 in that the position of the polishing section 82 can be adjusted relative to the polishing unit body support member 81.

The polishing unit body support member 81 is detachably attached to the opening/closing cover 61 using the plurality of screws 64, similarly to the polishing unit body support member 71 of the polishing unit 70. For this reason, a plurality of screw holes 81*a* is disposed in the polishing unit body support member 81 so as to be arranged along a side of the polishing unit body support member 81 to be attached to the opening/closing cover 61.

The polishing section 82 has a configuration similar to that of the polishing section 72 of the polishing unit 70, and is constituted by a claw-like member (simulated peeling member) 821, a polishing member (rubbing member) 822 and a spring (not shown). The polishing section 82 is attached to the polishing unit body support member 81 so as to be pivoted, about a hinge part 83, within a certain range.

The hinge part 73 of the polishing unit 70 according to the first embodiment is permanently fixed to the polishing unit body support member 71. On the other hand, the position of the hinge part 83 of the polishing unit 80 according to the second embodiment can be adjusted relative to the polishing unit body support member 81. The position of the hinge part 83 is adjusted in the direction of the rotation shaft of the fixing belt.

In the polishing unit 80, in order to adjust the position of the hinge part 83, a base part 83*a* of the hinge part 83 can be moved along an elongated hole 81*b* disposed in the polishing unit body support member 81. Also, a shaft 83*b* of the hinge part 83 has a length enough to cover the entire movable range of the hinge part 83. That is, the position of the base part 83*a* can be adjusted by moving the base part 83*a* along the elongated hole 81*b* and the shaft 83*b*. The base part 83*a* whose position is thus adjusted can be fixed to the polishing unit body support member 81 by the screw 84.

As described above, in the polishing unit 80, the position of the polishing section 82 can be adjusted relative to the polishing unit body support member 81 by adjusting the position of the hinge part 83. Therefore, when the maintenance is performed on the fixing belt 53 using the polishing unit 80, the polishing section 82 can be positioned where the scratch of the belt has been generated. Thus, it is possible to avoid the excessive abrasion of the fixing belt 53 that is caused by polishing the portion that does not require the polishing (i.e., portion where no scratch has been generated). In order to facilitate the positioning, it is preferable that indexes 81*c* for positioning are disposed on the rear surface of the polishing unit body support member 81 (i.e., on the surface on which the hinge part 83 is attached) so as to indicate each size of the sheets (for example, B5, A4 and A4R).

Third Embodiment

Figure 8:
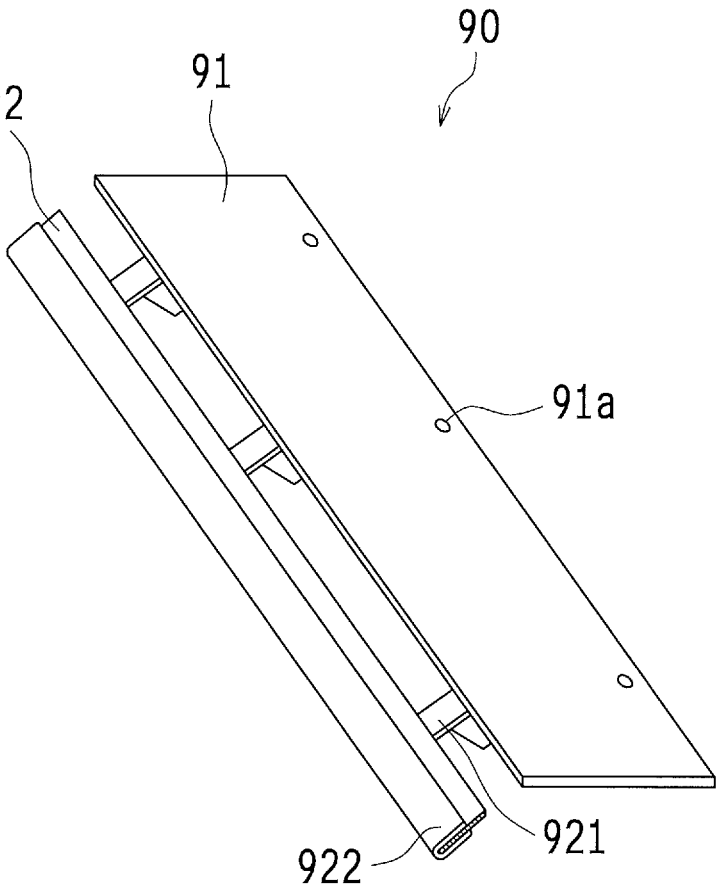
FIG. 8 is a perspective view of a cleaning unit according to the third embodiment.
Figure 9:
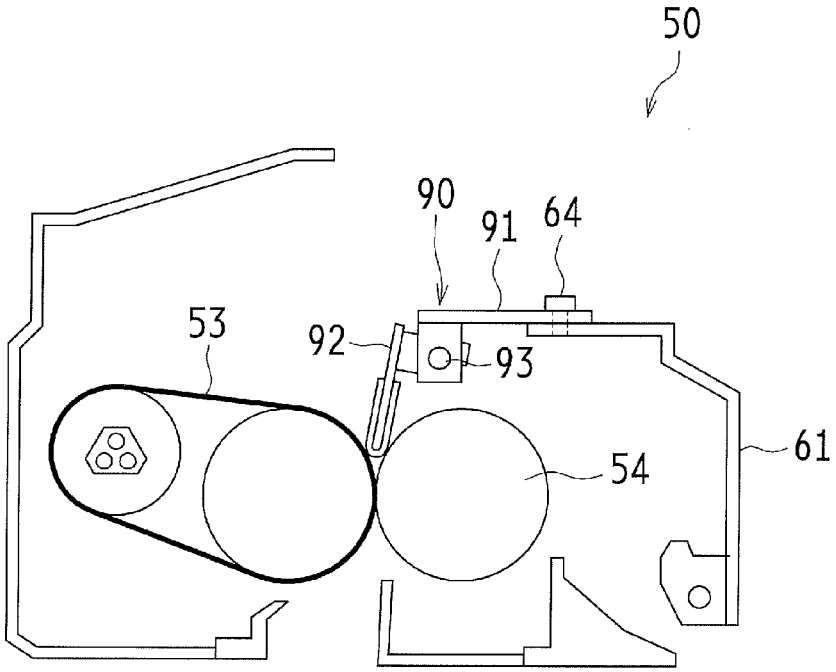
FIG. 9 is a cross-sectional view of the fixing device to which the cleaning unit shown in FIG. 8 is attached.

Hereinafter, description will be given on a cleaning unit according to the third embodiment with reference to the drawings. FIG. 8 is a perspective view of a cleaning unit (rubbing unit) 90 according to the third embodiment. FIG. 9 is a cross-sectional view of the fixing device 50 to which the cleaning unit 90 is attached. The cleaning unit 90 includes a cleaning unit body support member (support member) 91 and a single cleaning section 92. The polishing units 70 and 80 respectively according to the first embodiment and the second embodiment are to polish the scratched fixing belt 53 as the maintenance operation on the fixing device 50. In contrast, the cleaning unit 90 according to the third embodiment is to clean the fixing belt 53 or the pressure roller 54 as the maintenance operation on the fixing device 50.

The cleaning unit body support member 91 is detachably attached to the opening/closing cover 61 using the plurality of screws 64, similarly to the respective polishing unit body support members 71 and 81 of the polishing units 70 and 80. For this reason, a plurality of screw holes 91*a* is disposed in the cleaning unit body support member 91 so as to be arranged along a side of the cleaning unit body support member 91 to be attached to the opening/closing cover 61.

The cleaning section 92 is constituted by a claw-like member (simulated peeling member) 921 and a cleaning member (rubbing member) 922. The cleaning section 92 is attached to one end (opposite to the end attached to the opening/closing cover 61) of the cleaning unit body support member 91 so as to be pivoted, about a hinge part 93, within a certain range.

Unlike the claw-like members 721 and 821 of the polishing units 70 and 80, the claw-like member 921 of the cleaning section 92 has a large width in the direction of the rotation shaft of the fixing belt. The cleaning member 922 is attached to the front edge of the claw-like member 921. When the maintenance is performed on the fixing device 50, the cleaning member 922 rubs and cleans the fixing belt 53 and/or the pressure roller 54. The cleaning member 922 also has a large width in the direction of the rotation shaft of the fixing belt, thus it can clean the entire region constituted by the fixing belt 53 and the pressure roller 54 for passing the sheets.

As described above, in the fixing device 50 according to the third embodiment, the fixing belt 53 and/or the pressure roller 54 can be cleaned using the cleaning unit 90 as the maintenance operation on the fixing device 50. In this way, it is possible to eliminate the conventional cleaning unit disposed in the fixing device 50, which leads to further downsizing of the fixing device 50.

In the respective embodiments as described above, the belt fixing type fixing device is exemplarily shown, and the rubbing unit of the present invention is to rub the fixing belt. However, the present invention is not limited thereto. The present invention may be applied to a fixing device that has a configuration in which the toner image is fixed on the sheet between the fixing roller (heating roller) and the pressure roller. In this case, the rubbing unit of the present invention may be configured to rub the fixing roller and/or the pressure roller.

The present invention should not be limited to the foregoing embodiments. Various changes and modifications may be made in the invention without departing from the scope of the claims. Any embodiments obtained by appropriately combining the technical means respectively disclosed in the different embodiments of the invention are also embraced in the technical scope of the invention.

What is claimed is:

1. A rubbing unit used in a device having a rotary member and a pivoting member that covers the rotary member, the rubbing unit being configured to rub the rotary member, comprising:

a support member detachably attached to the pivoting member; and a rubbing member held by the support member, the rubbing member being configured to make contact with the rotary member so as to polish a surface of the rotary member when the pivoting member is closed, wherein the rubbing member is detachably attached to the rubbing unit.

2. The rubbing unit according to claim 1, wherein the rubbing member is attached to a simulated peeling member that is mounted on the support member.

3. The rubbing unit according to claim 2, wherein the simulated peeling member has a shape similar to a peeling member configured to peel, from the rotary member, a sheet on which an image has been formed.

4. The rubbing unit according to claim 2, wherein, as the simulated peeling member, a plurality of claw-like members is arranged along the rotary member at a predetermined interval.

5. The rubbing unit according to claim 1, wherein the rubbing member is a member configured by adding, to a simulated peeling member that is mounted on the support member, a function of polishing the surface of the rotary member.

6. The rubbing unit according to claim 5, wherein the simulated peeling member has a shape similar to a peeling member configured to peel, from the rotary member, a sheet on which an image has been formed.

7. The rubbing unit according to claim 5, wherein, as the simulated peeling member, a plurality of claw-like members is arranged along the rotary member at a predetermined interval.

8. The rubbing unit according to claim 1, wherein the rubbing member is an abrasive to polish the rotary member.

9. The rubbing unit according to claim 8, wherein a position of the rubbing member relative to the support member is adjusted in a direction perpendicular to a sheet transport direction.

10. The rubbing unit according to claim 9, wherein indexes indicating respective sizes of sheets are disposed on the support member so that the position of the rubbing member is adjusted corresponding to the indexes.

11. A fixing device to be included in an image forming apparatus, comprising:

a rotary member configured to pass a recording sheet therethrough and fix an image on the recording sheet; and a pivoting member configured to cover the rotary member, wherein the pivoting member has a configuration in which a peeling-member support member for holding a peeling member or the rubbing unit according to claim 1 is selectively attachable.

12. An image forming apparatus comprising the fixing device according to claim 11.

13. A method for performing maintenance on a fixing device by polishing a surface of a rotary member included in the fixing device, the fixing device as a unit capable of being installed in an image forming apparatus, wherein the fixing device includes:

the rotary member configured to pass a recording sheet therethrough and fix an image on the recording sheet; and a pivoting member configured to cover the rotary member, and wherein the pivoting member has a configuration in which a peeling-member support member for holding a peeling member or the rubbing unit according to claim 1 is selectively attachable, the method comprising:

a first step of attaching the rubbing unit by opening the pivoting member and by detaching the peeling-member support member;

a second step of installing, in the image forming apparatus, the fixing device with the rubbing unit in a state in which the pivoting member is closed; and a third step of polishing the surface of the rotary member by rotating the rotary member.

* * * * *